US005803184A

United States Patent [19]

Van der Wouden

[11] Patent Number: 5,803,184

[45] Date of Patent: Sep. 8, 1998

[54] ROTATABLE DRILL PIPE HAVING AN AUGER ON A FREE END THEREOF

[75] Inventor: Adriaan Van der Wouden, Ouderkerk aan de IJssel, Netherlands

[73] Assignee: Fundamentum B.V., Sliedrecht, Netherlands

[21] Appl. No.: 637,474

[22] Filed: Apr. 25, 1996

[30] Foreign Application Priority Data

Apr. 25, 1995 [NL] Netherlands ..... 1000217

[51] Int. Cl.[6] ..... E02D 5/56; E02D 5/62

[52] U.S. Cl. ..... 175/21; 175/22; 405/236; 405/241

[58] Field of Search ..... 175/20–22; 405/224.2, 405/232, 236, 240, 241

[56] References Cited

U.S. PATENT DOCUMENTS

| | | | |
|---|---|---|---|
| 1,665,798 | 4/1928 | Sipe | 405/240 X |
| 3,438,212 | 4/1969 | Turzillo | 405/236 |
| 3,485,052 | 12/1969 | Turzillo . | |
| 3,540,225 | 11/1970 | Muller . | |
| 4,484,640 | 11/1984 | Feklin et al. | 175/21 X |
| 4,533,279 | 8/1985 | van der Elzen et al. | 405/241 X |
| 4,623,025 | 11/1986 | Verstraeten | 175/21 |
| 5,279,502 | 1/1994 | Goughnour | 405/240 X |

FOREIGN PATENT DOCUMENTS

| | | |
|---|---|---|
| 881.598 | 5/1980 | Belgium . |
| WO 95/12050 | 5/1995 | WIPO . |

*Primary Examiner*—Roger J. Schoeppel
*Attorney, Agent, or Firm*—Young & Thompson

[57] ABSTRACT

Method and device for introducing a pipe into the ground. In order to restrict the drive power necessary to the greatest possible extent and to optimize the diameter of the pipe, it is proposed that the soil surrounding the pipe is displaced in the radial direction. To this end the pipe is provided with one or more displacement elements.

14 Claims, 3 Drawing Sheets

ROTATABLE DRILL PIPE HAVING AN AUGER ON A FREE END THEREOF

BACKGROUND ART

This invention relates to a method for introducing a pipe into the ground as well as a drill pipe. U.S. Pat. No. 3,485,052 describes a pipe which is provided with an auger-like screw over the entire length thereof. To prevent upward transport of material, a number of obstructing partitions are provided, which obstructing partitions extend between successive screw threads essentially parallel to the center line of the pipe. The obstructing partitions extend perpendicular to the pipe surface in the radial direction. After a hole has been bored using this device, grouting material is poured into the space left behind as the pipe is withdrawn. This device is best suited for soils which consist of material having a relatively loose granular structure. A problem is that material which is shifted by the screws will be moved over and along the obstructing partition as the latter approaches, as a result of which the obstructing partition exerts only a braking action. Consequently, certainly when withdrawing the pipe and introducing the grouting material, an appreciable amount of soil material, which may or may not be mixed with the grouting material, will be brought to the top. This is undesirable in many applications.

Patent publication WO 95/12050 proposes a construction in which the pipe widens out conically frogs the drill point and then conically tapers again. A screw having a pitch opposite to the pitch of the drill section is provided in the conically tapering section. Furthermore, displacement elements are provided, which extend over a few turns of the screw. The upward shifting of soil material is effectively prevented in this way. The drawback of this device is that it is relatively expensive and particularly complicated to produce. Moreover, a high torque and thus a great deal of energy is required for driving.

Belgian Patent publication 881 598 describes a drill pipe which has a drill head at the free end, which drill head is provided with displacement elements. In this publication it is assumed that the soil moves back to a limited extent after the displacement elements have passed through. However, there is no guarantee whatsoever that this is the case, whilst, furthermore, there is the drawback that, if the soil material does move back, a hole has to be made which is larger than the final diameter of the bore hole. Finally, U.S. Pat. No. 3,540,225 describes a construction with which a pipe is introduced into the ground by driving, that is to say not by rotating.

The aim of the present invention is to provide an improved method with which the soil material can be effectively displaced such that upward transport of large amounts of material is prevented, without a high drive torque being required, it being possible to carry out this method in a particularly simple manner using relatively simple means.

SUMMARY OF THE INVENTION

According to a first aspect the invention relates to a method for introducing into the ground an element consisting of set fluid material, comprising the introduction of a pipe into the ground by screwing with simultaneous displacement of the soil material, wherein during the downward screwing movement a setting fluid is introduced at least in the vicinity of the free end of the pipe, in that screwing takes place exclusively in the vicinity of the free end of the pipe and in that the displacement takes place over essentially the entire length of the pipe.

The fluid material assists in displacement during the downward movement. Furthermore, this holds the displaced soil material at a distance. The various aspects are further promoted because the displacment takes over the entire length of the pipe. In contrast to the construction disclosed in U.S. Pat. No. 3,485 052, screwing takes place exclusively in the vicinity of the free end of the pipe. With the method according to the invention soil material is actually displaced and not impeded.

Using the drive unit described above, pipes having a diameter of between, for example, approximately 30 and 120 cm can be installed, depending on the drive power.

The length over which such pipes can be introduced can be up to 30 meters or more.

As a result of the lower power needed to rotate the (drill) pipe and to introduce to it into the grounds it is also possible to restrict the nuisance inflicted on the surroundings. This relates not only to nuisance in view of the size of the drive installation but also to noise and motor emissions and the nuisance caused by vibration.

There is an essential difference between the method proposed according to the invention for displacement of the soil and techniques and methods with which soil is moved upwards by a spiral with the aid of auger-like components. In the present invention, the soil surrounding the pipe is displaced in a radial direction. In the latter case the friction between the underlying sail and the drill pipe will increase and additional drilling torque and pulling force for removal are needed compared with those required for the construction with a smooth drill pipe. It is possible to restrict the casing friction of the drill pipe with the aid of the method according to the present invention.

If the setting fluid is injected at the same time as the pipe is introduced, it is possible for the fluid to exert a lubricating action, in addition to any groundwater which may be present, between the outside of the pipe and the surrounding soil.

It is possible to leave the pipe permanently in the ground after it has been introduced or to remove it from the ground again. In the latter case, the hole produced on removal must preferably be filled with setting fluid and/or water.

The method described above is suitable both for the production of a foundation pile and for the production of water-retaining barriers, pre-drilling work, jet grouting or the like.

For the production of barriers, the drill pipe is moved successively downwards and then up again in a number of positions located in a series. During this operation a mixture of a fluid which subsequently sets or stiffens is introduced into the ground. This gives rise to a build-up such that a relatively large concentration of setting fluid is present close to the center of the location in which the drill pipe is introduced, which concentration of fluid becomes increasingly lower in the radial direction from the position. However, in combination with the soil already present, an adequate seal is produced.

According to a further aspect the invention relates to a device for introducing a setting fluid material into the ground over an appreciable depth, in order to form an element, with the aid of a pipe of essentially constant diameter introduced into the ground by rotating. The pipe is provided with means for introducing a setting fluid via the means outside the circumscription of the pipe. The pipe is provided on the outside with at least one displacement element. The displacement element extends either parallel to the center line of the pipe or at an angle therewith, the pitch being at least five times the external diameter of the pipe. The pipe is provided with a drill element at the free end, wherein from the drill element the pipe is essentially smooth over the entire length thereof and is provided only with the at least one displacement element. The displacement element or elements extend essentially over the entire length of the pipe.

In order to provide for optimum displacement, the angle between the displacement element and the outer circumference of the pipe viewed in the direction of flow is in the range between 120° and 150°. The displacement element preferably extends over a restricted portion of the circumference of the pipe and the portion makes up at most ⅙ of the circumference thereof.

The displacement elements and the drill pipe can each be of any shape conceivable by those skilled in the art, Preferably, however, the displacement elements are constructed as ribs. In this context it is possible for the displacement elements to be fitted such that they are retractable with respect to the pipe. The displacement elements can, moreover, be of any length. This length can vary from a few centimeters to a length equal to that of the drill pipe.

The drill pipe according to the invention can be provided with a so-called drill point close to the free end at the bottom. It is essential only that displacement elements are provided over part of or the entire length of the pipe.

The radial height of the displacement elements or ribs is preferably between approximately 15 and 150 mm. The height depends on the application and diameter of the drill pipe and the composition of the soil. Moreover, it is possible for the height to increase or decrease towards the bottom, viewed over the length of the drill pipe.

It is also possible to construct the rib or the displacement element such that a cavity for transport of the setting fluid is formed inside it, that is to say within the bounds between the rib and the drill pipe. It is, of course, also possible for setting fluid to move, in addition or exclusively, through the interior of the drill pipe. Optimum lubrication is obtained if outlet openings for the fluid are made in the ribs. This opening can be elongated or circular close to the bottom of the drill pipe, but can likewise comprise a number of openings distributed over the height of the drill pipe. With this arrangement it must, of course, be possible for the openings located higher up to be closed off in some way or other, if such openings extend above ground level. For some applications the drill pipe will be built up during operation by coupling various pipe sections.

DETAILED DESCRIPTION OF THE INVENTION

Figure 1:
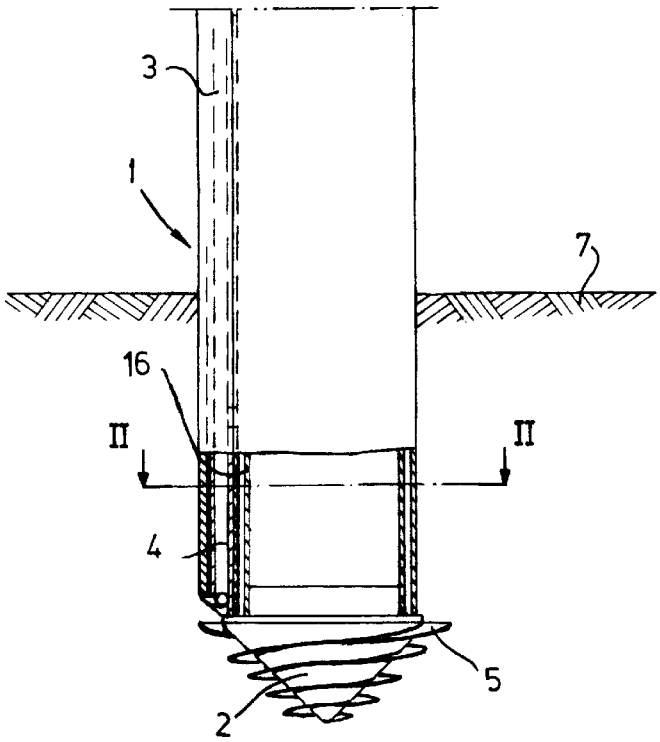
Figure 2:
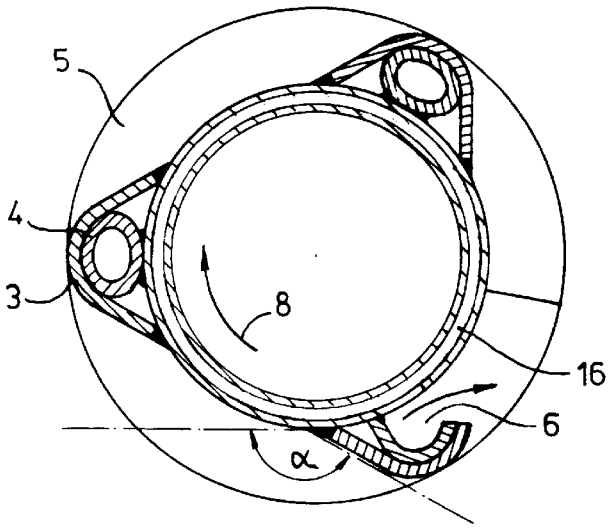
Figure 4:
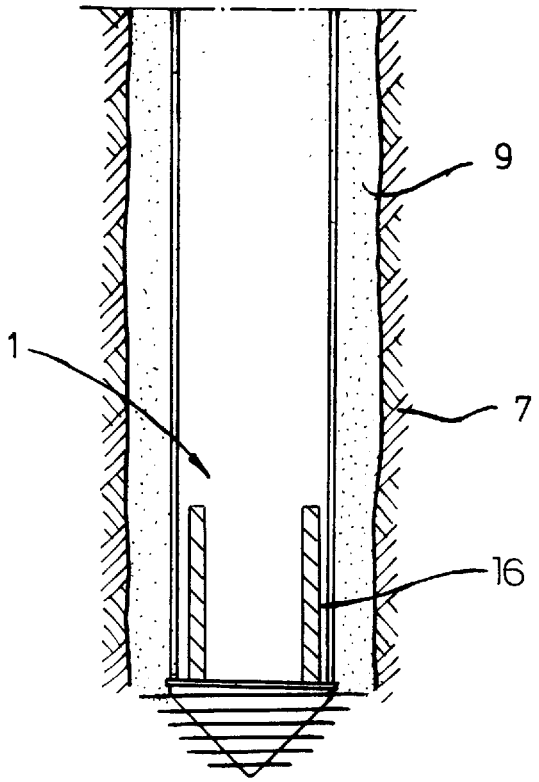
Figure 5:
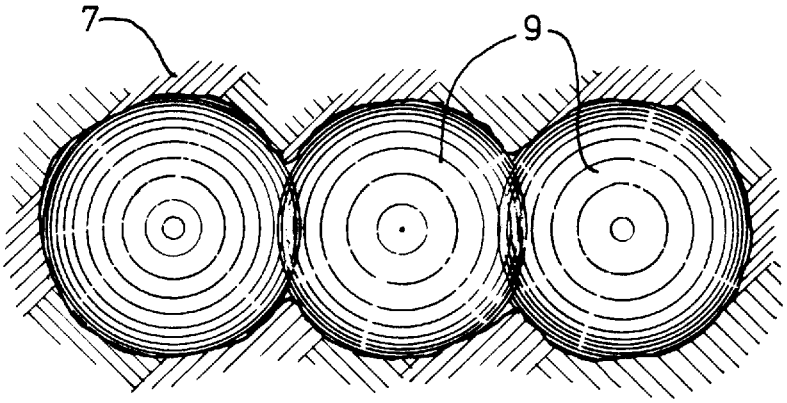

These and other features of the present invention will become more apparent upon reading the following description taken in conduction with the accompanying drawings, wherein FIG. 1 shows diagrammatically, in cross-section, a drill pipe according to the invention introduced into the ground;

FIG. 2 shows a cross-section along the line II—II in FIG. 1;

FIGS. 3*a* to 3*e* show further embodiments of the drill pipe according to the invention;

FIG. 4 shows the distribution of grouting material following introduction of a drill pipe according to the invention into the ground, and FIG. 5 shows a top view of a method for the production of a barrier with the aid of the drill pipe according to the invention.

DESCRIPTION OF THE PREFERRED EMBODIMENT

In FIG. 1 the drill pipe according to the invention, which is indicated in its entirety by 1, has been introduced into ground 7. Although this pipe is shown in the figure as a single part, it is readily possible that this pipe is built up of several parts. Drill pipe 1 is provided with a point 2 which has screw and/or displacement means 5. The screw and/or displacement means 5 serve to render penetration into the soil possible when shifting soil material. Above the screw and/or displacement means 5 the drill pipe 1 is of essentially circular construction, as can be seen from FIG. 2. The pipe is, however, provided with three displacement elements or ribs 3. In the embodiment shown the ribs are of triangular construction and a channel 4 is delimited inside them, which channel is joined, in a manner which is not shown in more detail, to a feed for setting fluid, such as grouting material. This feed is formed by the space between jacket 16 and drill pipe 1. As can be seen by reference to FIGS. 1 and 2, the ribs 3 are provided with outlet openings 6. In FIG. 2 an arrow 8 indicates the direction of rotation of the pipe 2 during introduction and it can be seen from this that the discharge of grouting material through opening 6 is rendered possible by the leading edge of rib 3.

As can be seen from FIG. 2, the flow angle $\alpha$, that is to say the angle between the contact surface of the pipe and the contact face of rib 3, is in the range between 120° and 150°. The diameter of the pipe used can be between 20 and 100 cm.

In the embodiment shown in FIGS. 1 and 2, the ribs extend only in the vertical direction over the entire length of the pipe.

Figure 3:
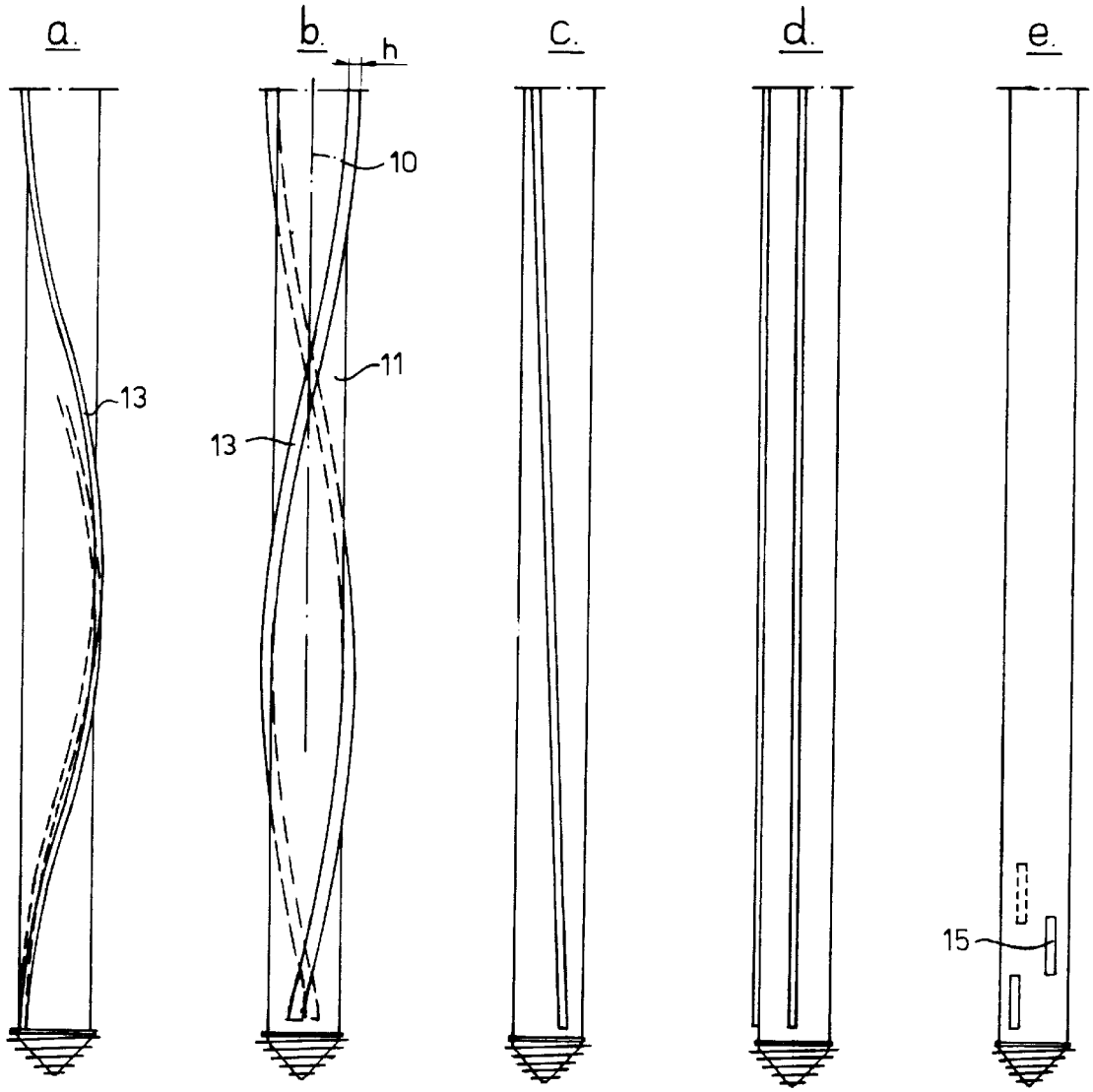

However, it is also possible for these ribs to make a small angle with the center line 10 of the pipe 11, as is shown in various variants in FIGS. 3*a*–3*d*. In FIG. 3*a* the rib which extends spirally is indicated by 13. It can be seen that the pitch of a rib of this type is particularly large and of the order of from a few to tens of meters. In FIG. 3*d* the rib extends in a straight line, whereas in FIG. 3*e* a number of short ribs 15 is arranged which form a continuous series and are offset with respect to one another.

FIG. 4 shows the pipe from FIG. 1 after introduction of grouting material has been completed.

It can be seen that the section 9 of the ground 7 in which grouting material is present is many times larger than the size of the pipe. In this way a large surface area of the ground can be covered in a particularly efficient manner.

FIG. 5 shows a number of such sections 9 located alongside one another. A barrier can be built up in this way. With this procedure the drill pipe is removed after making the opening.

In the construction described above the rib is of triangular design. However, it must be understood that the rib can have any other acceptable shape, for example sinusoidal. The shape chosen for the rib is partly dependent on the type of ground to be bored through. This applies in particular to that portion of the rib which first comes into contact with the soil material. The portion on the trailing side can be chosen virtually arbitrarily, but in view of the fact that the direction of rotation can or must also be reversed, this side of the displacement element or rib can be of the same construction as the leading side just described. The rib can be fixed with respect to the drill pipe in any manner known from the prior art. For instance, the rib can be of retractable construction, but it is likewise possible to fix the rib by welding to the drill pipe. With this arrangement both the drill pipe and the triangular rib can be made of steel. However, preference is given to the use of a relatively high grade material for the ribs because the ribs are exposed to an appreciable load when effecting displacement. As a result it is also possible to keep the thickness of the material of the rib relatively small. With the aid of the drill pipe described above it is possible to use a larger pipe diameter for the same power or the same pipe diameter at a lower power. With this arrangement it is not necessary further to increase the thickness of the wall of the pipe. The friction between the drill pipe and the surrounding soil is limited by the displacement elements, which effect can be even further promoted by the lubricating action of the setting fluid which is introduced.

The construction according to the invention can be produced simply, that is to say at low cost, it still being possible to recover the pipe after use.

Outflow of the grouting mixture through the outflow openings can be realised by means of an open system or can be controlled with the aid of valves. Any setting fluid can be used with the method described above. In this context preference is given to grout and the introduction pressure can be between 2 and 600 atm.

Although the invention has been described above with reference to a circular opening in the drill pipe, it will be understood that said opening can have any other shape, such as square, rectangular, etc. Similar variations in the various components likewise apply for other constructions of the drill pipe. Such variations can comprise all construction details known from the prior art.

It must be understood that these and other variants obvious to a person skilled in the art lie within the scope of the appended claims.

What is claimed is:

1. A device for creating one of a tube and a barrier in the ground, comprising:

a rotatable drill pipe having a free end;

at least one displacement element on an exterior of said drill pipe extending substantially an entire length of said drill pipe to a vicinity of the free end; and introducing means for introducing a setting fluid into the ground surrounding said drill pipe from an end of said at least one displacement element at the vicinity of the free end of said drill pipe.

2. Device according to claim 1, wherein the angle ($\alpha$) between the displacement element and the outer circumference of the pipe is between 120° and 150° in the direction of flow.

3. Device according to claim 1, wherein the displacement element extends over at most ⅙ of the circumference of the pipe.

4. Device according to claim 1, wherein the displacement element comprises a rib.

5. Device according to one of claim 4, wherein a radial depth (h) of the rib is 15–100 mm.

6. Device according to claim 4, wherein the rib is of hollow construction, the rib having a cavity equipped for transporting the setting fluid.

7. Device according to claim 6, wherein the cavity is provided with outlet openings for the fluid.

8. Device according to one of claim 1, wherein the pipe is provided, at least at the free end, with screw drilling means.

9. Device according to claim 8, wherein the radial depth of the rib changes in the longitudinal direction of the pipe.

10. A device according to claim 1, wherein said at least one displacement element is parallel to a longitudinal axis of said drill pipe.

11. A device according to claim 10, wherein said at least one displacement element is at an angle with a longitudinal axis of said drill pipe.

12. A device according to claim 11, wherein a pitch of said at least one displacement element is at least five times an external diameter of said drill pipe.

13. A rotatable drill pipe having a free end, an auger on said free end for penetrating soil, and along a substantial portion of the remainder of the height of the drill pipe at least one radially outwardly extending rib that displaces soil substantially only radially outwardly, and means for introducing a setting fluid into the soil adjacent said free end.

14. A rotatable drill pipe as claimed in claim 13, wherein said introducing means includes a conduit for said setting fluid, said conduit extending lengthwise of the drill pipe within said at least one rib.

* * * * *